United States Patent [19]

Shigeru

[11] 4,435,963

[45] Mar. 13, 1984

[54] MEANS FOR RETAINING JEWELERY FOR INTERLOCKING WITH PRECISE PREFORMS

[75] Inventor: Jhono Shigeru, Los Angeles, Calif.

[73] Assignee: Tempo G, Los Angeles, Calif.

[21] Appl. No.: 258,287

[22] Filed: Apr. 28, 1981

Related U.S. Application Data

[63] Continuation-in-part of Ser. No. 146,488, May 5, 1980, Pat. No. 4,283,831.

[51] Int. Cl.[3] ..... A44C 15/00; B65D 45/32

[52] U.S. Cl. ..... 63/18; 29/160.6; 29/426.6; 29/453; 220/319; 411/445; 411/517

[58] Field of Search ..... 63/19, 20, 29 R, 18; 29/160.6, 426.6, 453; 292/256.6; 220/319; 411/216, 217, 445, 442, 517, 518, 519, 530

[56] References Cited

U.S. PATENT DOCUMENTS

| | | | |
|---|---|---|---|
| 648,523 | 5/1900 | Pierce | 40/156 |
| 733,029 | 7/1903 | Gosling | 63/29 |
| 786,957 | 4/1905 | Crane | 220/319 X |
| 1,044,552 | 11/1912 | Martin et al. | 292/256.63 X |
| 1,207,937 | 12/1916 | Kruse | 292/256.6 X |
| 1,765,239 | 6/1930 | Meurling | 220/319 X |
| 1,972,522 | 9/1934 | Keller | 63/18 X |
| 2,025,545 | 12/1935 | Muff | 29/453 UX |
| 2,350,651 | 6/1944 | Taubert et al. | 220/319 X |
| 2,366,510 | 1/1945 | Frank | 411/445 X |

FOREIGN PATENT DOCUMENTS

| | | | |
|---|---|---|---|
| 119593 | 2/1945 | Australia | 411/216 |
| 785957 | 5/1935 | France | 411/518 |
| 15796 | of 1910 | United Kingdom | 63/18 |
| 662321 | 12/1951 | United Kingdom | 411/517 |

*Primary Examiner*—F. Barry Shay

*Attorney, Agent, or Firm*—Thomas I. Rozsa

[57] ABSTRACT

An improved apparatus incorporated in a cast metal frame of circular configuration to allow one frame to accommodate similar objects of slightly different sizes and retain them therein to prevent rotation of the object within the cast frame. Further improvements are designed in the retaining means which rigidly hold the object in cast frames of circular, rectangular and oval configurations while at the same time allowing the retaining means to be easily removed.

49 Claims, 13 Drawing Figures

MEANS FOR RETAINING JEWELERY FOR INTERLOCKING WITH PRECISE PREFORMS

BACKGROUND OF THE INVENTION

This application is a continuation-in-part of patent application Ser. No. 06/146,488, filed on May 5, 1980, now U.S. Pat. No. 4,283,831.

That patent application discloses a unique method of manufacturing a jewelry frame casting of metal such as gold by use of a model form key so that the finished casting holds precise dimensions in certain critical areas. The finished product consists of a metal frame with a critical dimension inner wall which is designed to retain a jewelry item such as a coin or medallion with a fit as close as possible, and an annular groove below the critical dimension inner wall which accommodates retaining wires which hold the coin or medallion in place. Among the frame shapes discussed are circular, rectangular and oval configurations.

SUMMARY OF THE INVENTION

The present invention relates to specific apparatus improvements in the invention disclosed in patent applications Ser. No. 06/146,488, now U.S. Pat. No. 4,283,831. More particularly, the present invention relates to the addition of an improvement which is incorporated within the cast metal frame of circular configuration to allow one frame to accommodate similar objects such as a coin or medallion which are of slightly different sizes due to wear on the object prior to insertion in the cast frame. The present invention further consists of modified forms of retaining rings which enable the ring to be easily removed should one desire to remove the coin or medallion while at the same time providing a retaining ring which rigidly holds the coin or medallion in place within the cast frame.

Coins or medallions can vary due to wear factors experienced by the object before it is inserted in the cast frame. Referring specifically to cast frames of circular configuration, if the coin or medallion is sufficiently undersized due to the wear factor, it will rotate within the cast frame. The improvement which solves this problem consists of two parts. First, a notch which for example can be a half round slot is added to the interior wall of the cast frame. The notch or half round slot runs transverse to the circular wall which accommodates the coin or medallion within the cast frame. Second, the improvement further consists of adding an anti-rotation pin which fits tightly within the half round slot. Use of this anti-rotation pin is optional, depending upon the degree of wear in the coin. If the coin fits tightly within the cast frame, is held securely in place by the spring retaining ring and does not rotate, the anti-rotation pin is not required. However, if the coin is undersized by a sufficient amount so that it rotates in a circular fashion within the cast frame in spite of the spring retaining ring, then the anti-rotation pin is added. The anti-rotation pin fits tightly within the half round slot and tightly against the undersized coin or medallion, thereby preventing the coin or medallion from moving in a circular direction within the cast frame.

A further improvement of the present invention involves a special design for the spring retaining ring which holds the coin or medallion within the cast frame. It is the object of this improvement to provide a spring retaining ring which securely retains the coin or medallion within the cast frame while at the same time enabling the spring retaining ring to be easily removed should one desire to remove the coin or medallion within the cast frame. To accomplish this goal, the improvement consists of two alternative embodiments. The first embodiment consists of placing a kink near one end of the spring retaining ring. For example, a kink can be approximately fifteen (15) degrees from one end. In this embodiment, the spring retaining ring is placed within the cast frame so that the two open ends abut one another. The location of the kink relative to the half round slot is not important. The kink provides an area where a safety pin or other small sharp object may be inserted to remove the spring retaining ring should one desire to remove the coin or medallion. While the spring retaining ring fits securely within the groove of the cast frame, the kink allows it to be easily removed without damage to either the coin or the cast frame components.

In the second embodiment, the spring retaining ring is completely smooth and contains no kink. In order for the spring retaining ring to be easily removed, it is necessary that one open end be within approximately fifteen (15) degrees of the half round slot. To be certain that the spring retaining ring is placed within the groove of the cast frame such that at least one end lies within approximately fifteen (15) degrees of the half round slot, a web or fill is placed adjacent the half round slot and extends for approximately fifteen (15) degrees. In this way, both ends of the spring retaining ring abut the edges of the fill. Through this configuration, the spring retaining ring fits securely within the annular groove and securely retains the coin or medallion within the cast frame while at the same time the spring retaining ring can be easily removed through use of a safety pin or other small pointed object inserted into the half round slot.

A further improvement relates to the improved design of cast frames and retaining wires therefor is rectangular and oval configurations. Patent application Ser. No. 06/146,488 discloses frames of rectangular and oval configurations which contain central slots that accommodate teeth at the ends of the spring retaining wires. A problem with this configuration arises because the use of a central slot does not allow for reasonable tolerance in making the retaining wires. If the fit of the teeth into the slot is not completely precise, the spring retaining wires are likely to pop out under pressure at the location of the central slots in the frame. The improved configuration has eliminated the central slots in frames of rectangular and oval configurations for cast frames and has eliminated the teeth at the ends of the retaining wires. Instead the retaining wires are contoured or slightly prestressed and contain no teeth. Further, inside the cast frame, the annular groove within which the ends of the retaining wires fit is designed at an angle so that the central portion is approximately twenty percent (20%) deeper than the portions at the edges. In this way, the ends of the retaining wires will be further recessed within the perimeter.

Two alternative embodiments for the retaining wire assembly are possible for rectangular configurations. First the retaining wire can consist of two wires, each of which contain three longitudinal edges that are approximately at right angles to one another. The two wires are placed in the rectangular cast frame such that their open ends abut one another in the area of the deeper recess in the annular groove. In the alternative embodiment, the retaining wire consists of a single piece, with its two open ends abutting one another in the area of a deeper recess within the annular groove.

In the case of a rectangular configuration, it is necessary to bow the longitudinal sides of the rectangular retaining wires. The bowing serves a dual purpose. First, it allows portions of the edges to lie flush within the groove so that the retaining wires will securely maintain the object within the cast frame. Second, it enables one to remove the retaining wire through the use of a safety pin or comparable object placed at the central point of a longitudinal edge.

Two alternative embodiments for the retaining wire assembly are possible for oval configurations. First, the retaining wire can consist of two semi-oval shaped wires. The two wires are placed in the oval cast frame such that their open ends abut one another in the area of the deeper recess in the annular groove. In the alternative embodiment, the retaining wire consists of a single piece, with its two open ends abutting one another in the area of a deeper recess within the annular groove. In order to enable the wire(s) in the oval configuration to be easily removed, the two alternative embodiments previously discussed for spring retaining rings in the circular configuration are applicable. First, a kink may be placed in the oval wire, with the kink being approximately at a fifteen (15) degree arc from one end. Alternatively, a notch may be placed in the cast frame and positioned within approximately a fifteen (15) degree arc from the short axis of the oval frame. In the case of a single wire, both ends abut each other. In the case of two retaining wires, one end from each wire will abut the adjoining end of the opposite wire.

It has been discovered according to the present invention that for cast frames of inner circular configuration, the placement of a notch or half round slot extending through the inner wall of the frame coupled with the insertion of an anti-rotation pin which fits tightly within the half round slot and tightly against the coin or medallion will prevent the coin or medallion from moving in a circular direction within the cast frame if the coin or medallion is undersized due to wear and cannot be held against rotation by the spring retaining ring alone.

It has additionally been discovered according to the present invention that the placement of a kink within approximately fifteen (15) degrees of one end of the circular spring retaining ring will enable one to easily remove the spring retaining ring by use of a safety pin or other small pointed object. At the same time, the spring retaining ring securely supports the coin or medallion within the cast frame. Further, the use of a completely smooth retaining ring can also provide a retaining means which is easily removable provided at least one end of said ring lies within approximately fifteen (15) degrees from the location of the half round slot. The use of a fill adjacent the half round slot within the annular groove which accommodates the spring retaining ring assures that at least one end will be within approximately fifteen (15) degrees of the half round slot by allowing installation of the ring only in the desired position. The configuration also provides a spring retaining ring which securely maintains the coin or medallion within the slot.

It has also been discovered, according to the present improved invention that the elimination of the central slots in the annular grooves of cast frames of rectangular and oval configurations, designing the annular groove so that its central portion is approximately twenty percent (20%) deeper than the portion adjacent the edges, and the elimination of teeth at the ends of the rectangular shaped and oval shaped retaining wires provides a retaining means which is far less likely to pop out of its annular groove when pressure is applied to the face of the coin or medallion.

It has further been discovered that in rectangular configurations, it is necessary to bow the longitudinal sides of the rectangular retaining wire to assure that portions of the wire will lie flush within the annular groove in the cast frame and also to enable the retaining wire to be easily removed. This is applicable to a single retaining wire or to multiple retaining wires of semi-rectangular configuration.

It has additionally been discovered according to the present invention that the placement of a kink within approximately a fifteen (15) degree arc from one end of an oval shaped retaining wire will enable one to easily remove the oval shaped retaining wire from an oval shaped cast frame, by use of a safety pin or other small pointed object inserted at the area of the kink. This is applicable to a single piece wire or to multiple wires. Further, the use of a completely smooth oval retaining wire can also provide a retaining means which is easily removable provided at least one end of said wire lies within approximately a fifteen (15) degree arc from the location of a notch placed in the oval cast frame. This is applicable to a single wire or multiple wires.

It has also been discovered, according to the present improved invention, that the open ends of retaining wires, regardless of configuration (round, oval or rectangular) must abut each other (or the web or fill in the annular groove, if used) in order to prevent pop out of the retaining wire(s) when pressure is applied to the coin or medallion on the face opposite the retaining wire side. As disclosed in the patent application Ser. No. 06/146,488, the configuration and position of the annular groove within the cast frame provides vectored forces by spring action of the retaining wire(s) when installed in the annular groove such that approximately half of the total spring load is applied directly against the coin or medallion to secure the object within the frame, while the remaining spring load vector is applied outwardly against the inner wall of the cast frame to hold the retaining wire(s) in place. If a force greater than and directly opposing the spring load vector force against the coin or medallion is applied to the opposite face of the coin or medallion, this greater opposing force will attempt to compress the returning wire(s) within the annular groove and will serve to pop the retaining wire(s) out of the groove and allow the coin or medallion to be pressed out of the frame. In the applications perceived by this invention, removal of the retaining wire(s) and coin or medallion by the aforesaid means is highly undesireable. Thus, if the open ends of the retaining wire(s) are adjusted to abut each other when installed in the annular groove, compression of the retaining wire(s) by the greater opposing force just previously described cannot be accomplished and the wire(s) will remain in place to secure the coin or medallion within the cast frame. However, if an appreciable gap (more than half the diameter of the retaining wire(s)) is allowed between the open ends of the retaining wire(s) when installed, then the force opposing the vector spring load against the coin or medallion will readily compress the retaining wire(s) and pop them out of the annular groove. Thus, it is imperative that the lengths of retaining wire(s) be individually adjusted to assure that the open ends of the retaining wire(s) actually abut when installed and that there is neither an appreciable gap between nor an overlap of open ends when the retaining wire(s) are installed in the annular groove within the cast frame.

It is therefore an object of the present invention to provide an improved cast frame for retaining a circular coin or medallion which can accommodate circular objects of slightly different sizes while assuring that they will not rotate within the cast frame, and further to provide retaining means which will securely hold the circular coin or medallion in place while at the same time creating a retaining means which can be easily removed so as to allow the coin or medallion to be removed from the cast frame.

It is a further object of the present invention to provide a retaining means in cast frames of rectangular and oval configurations which eliminates the possibility of the retaining wires popping out accidentally and yet provides a configuration by which the retaining wires can be easily removed if necessary.

Further novel features and other objects of the present invention will become apparent from the following detailed description and the appended claims taken in conjunction with the drawings.

DRAWING SUMMARY

Referring particularly to the drawings for the purpose of illustration only and not limitation, there is shown:

FIG. 3 is an exploded perspective view of the improved product showing the four elements and the use of a fill within the annular groove and a smooth spring retaining ring as well as an anti-rotation pin.

DETAILED DESCRIPTION OF THE PREFERRED EMBODIMENT

The present invention relates to an improved apparatus for retaining a coin or medallion in a cast frame which is cast by the methods discussed, disclosed and claimed in patent application Ser. No. 06/146,488, filed May 5, 1980, now patent number 4,283,831.

Additionally, the improved apparatus may be utilized to retain a coil or medallion in a frame manufactured by means other than casting (e.g., machined from metal or other solid, rigid material stock such as tube, rod, bar, sheet or block; or struck by metal dies in a press) to achieve a configuration as described and disclosed in patent application Ser. No. 06/146,488 and herein.

The primary improvements relate to the apparatus for retaining circular coins or medallions in cast frames of internal circular configuration. The circular gold cast frame disclosed in patent application Ser. No. 146,488, now patent number 4,283,831 with circular spring gold retaining ring to hold a circular coin or medallion in place, provides an excellent frame assembly for the coin or medallion. One limitation of that configuration which has been discovered is that it is difficult to manufacture a circular frame which will precisely fit all coins or medallions of a given original size because the coins themselves are often undersized due to wear. A second limitation of that configuration results if the coin is undersized by a sufficient amount so that it will move in a circular direction within the cast frame. While this does not present the risk of the coin or medallion falling out, a circular rotation of the coin or medallion inside the frame could detract from the appearance of the entire assembly when it is worn on a chain around a person's neck or on a bracelet. The coin or medallion could appear at a slight rotation or even upside down.

Further, in the embodiment disclosed in patent application Ser. No. 06/146,488, now U.S. Pat. No. 4,283,831, the circular coin or medallion is not easily removable from the cast frame. While this is certainly advantageous in assuring tht the coin or medallion will not fall out, it does present a problem if the wearer should ever want to remove the coin or medallion. For example, if the coin is a gold coin such as a Krugerrand the the wearer should be in need of money if he loses his wallet, it would be difficult to remove the coin with the embodiment described in patent application Ser. No. 06/146,488, now U.S. Pat. No. 4,283,831. Therefore, to resolve the above described difficulties, improvements have been made in the apparatus for retaining circular coins or medallions.

Figure 1:
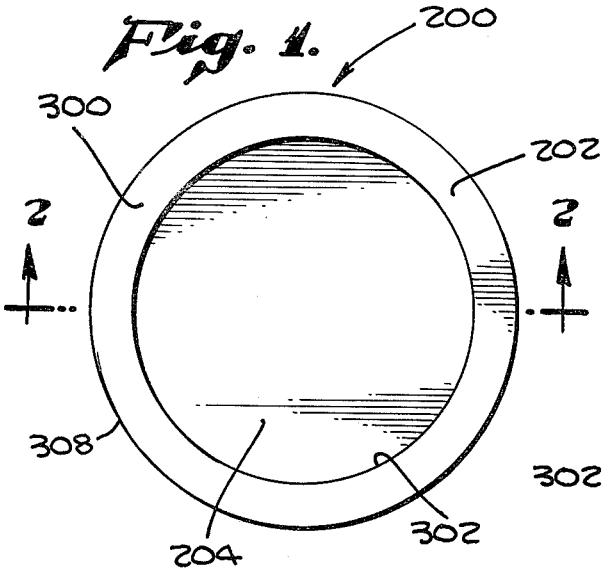
FIG. 1 is a top plan view of the improved circular cast frame with coin inserted.
Figure 2:
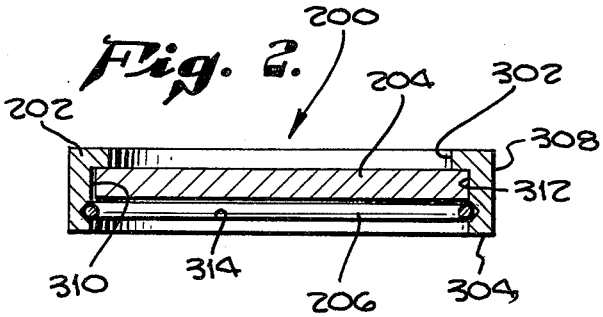
FIG. 2 is a cross-sectional view of the improved circular cast frame, taken along line 2—2 of FIG. 1.
Figure 2:
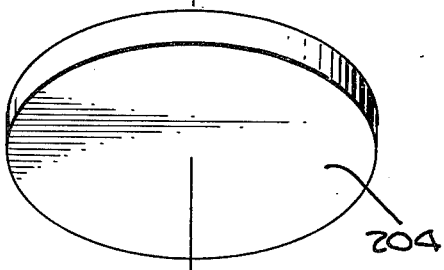
Figure 3:
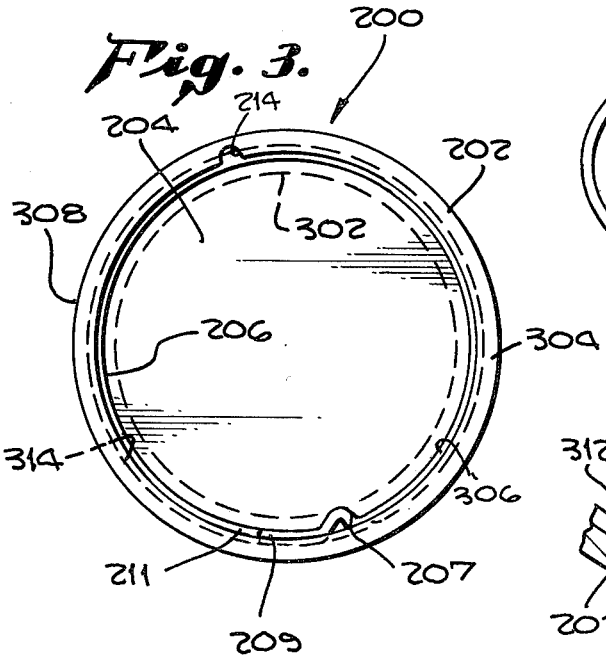
FIG. 3 is a bottom plan view of the improved circular cast frame with coin inserted and kinked circular spring retaining ring inserted.
Figure 3:
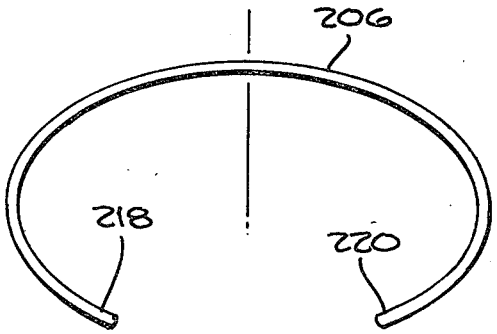

A top plan view of the improved circular cast frame assembly 200 with circular coin or medallion inserted is shown in FIG. 1. The cast frame is shown at 202 and the coin or medallion is shown at 204. The cross-sectional view of the circular cast frame assembly 200 shown in FIG. 2 shows the cast frame 202, the circular coin or medallion 204 and a spring retaining ring 206. The bottom plan view of FIG. 3 discloses the cast frame 202, the circular coin or medallion 204 and one improved embodiment of the spring retaining ring 206 containing a kink 207 which is located approximately within fifteen (15) degrees of one end 209 of the spring retaining ring 206. The two ends 209 and 211 of the spring retaining ring 206 abut one another in this configuration. Also shown in FIG. 3 is a notch or half round slot 214 placed within the wall of the cast frame 202. The location of the ends of the wire 209 and 211 relative to the half round slot 214 is not material. The ends can be anywhere relative to the half round slot.

Figure 5:
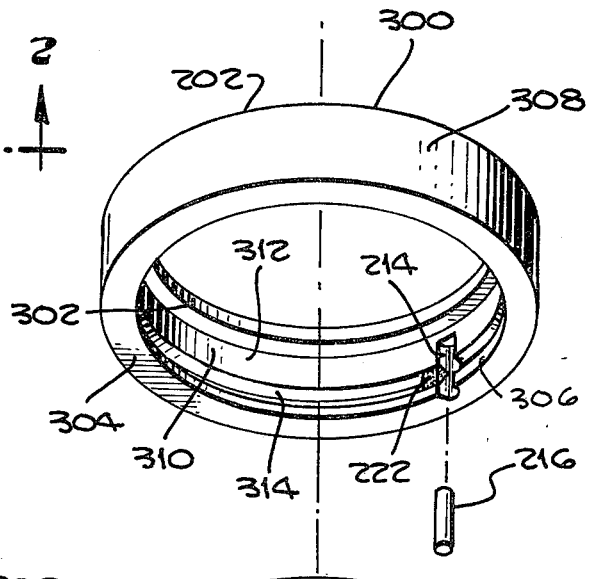

The elements of the cast frame are best illustrated in the exploded perspective view of FIG. 5 as well as the views in FIGS. 1 and 3. The cast frame 202 contains a circular upper face 300 having a large central hole 302 for exposing the coin or medallion 204. The cast frame 202 also contains a circular lower face 304 having a large central hole 306. The cast frame 202 further contains an outer transverse circumferential wall 308 perpendicular to both the upper face 300 and the lower face 304. The cast frame 202 also contains an inner transverse circumferential wall 310 which in turn contains a critical dimension inner wall 312 being only slightly larger than the coin or medallion 204 to be retained within it and a three hundred sixty (360) degree annular groove 314 running beneath the critical dimension inner wall 312 and within inner transverse circumferential wall 310. The distance between the annular groove 314 and the inner (lower) edge of central hole 302 is precisely controlled to accommodate the exact predetermined thickness of the coin or medallion to be installed in the frame. Coins or medallions of identical diameter but differing in thickness require different positioning of the annular groove 314 with respect to the inner edge of central hole 302. Thus, finished frames are peculiar to both the diameter and edge thickness of the coin or medallion for which they were manufactured.

The essential elements of an improved embodiment are best illustrated in the exploded perspective view of FIG. 5. As with the previous embodiment in patent application Ser. No. 06/146,488, now U.S. Pat. No. 4,283,831 the cast frame 202 contains a critical dimension inner wall 312 which is designed to receive the coin or medallion 204 with as close a fit as possible. The cast frame 202 also contains an annular groove 314 which receives the spring retaining ring 206. As in the previous embodiment, the angles of the annular groove 314 are approximately forty five (45) degrees from the horizontal, with the two edges of the annular groove 314 roughly perpendicular to each other.

By action of the retaining ring 206 unto itself, a claimping pressure is exerted against the surface of the coin or medallion 204 which serves to impede rotation of the coin or medallion, in the majority of instances. However, for coins or medallions which are sufficiently undersize, the retaining ring clamping pressure may not be sufficient to prevent rotation within the cast frame. If the coin rotates in a circular fashion within the cast frame, the coin may appear at an angle or even upside down. This significantly detracts from the appearance of the object when worn. In these instances an improvement is needed.

Figure 9:
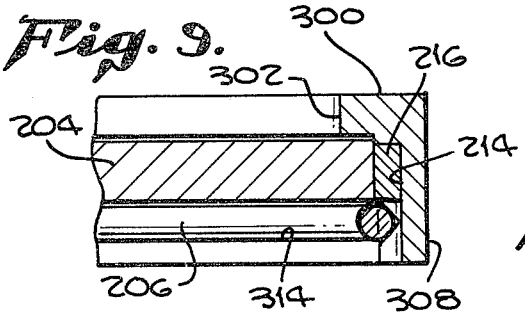
FIG. 9 is a partial cross-sectional view of the improved circular cast frame with coin or medallion inserted, anti-rotation pin cut short and spring retaining ring inserted.

The improvement which solves this problem consists of the following elements. First, a notch or half round slot 214 is cut in the inner transverse wall 310 of the cast frame 202. The half round slot 214 extends from the lower face 304 of the cast frame 202, through the annular groove 314 and through the critical dimension inner wall 312, stopping at the inner (lower) edge of central hole 302. Second, the improvement further consists of securing the coin or medallion in place by use of an anti-rotation pin 216 which is designed to fit precisely into notch or half round slot 214 and terminates just above the annular groove 314 as shown in FIG. 9 so as not to interfere with the spring retaining ring 206. The anti-rotation pin 216 fits tightly within the half round slot 214 and tightly against the undersized coin or medallion 214, thereby preventing the coin or medallion from moving in a circular direction within the cast frame's critical dimension inner wall 312 and thereby assuring that the coin or medallion won't rotate within the cast frame 202. In actual practice, the coin or medallion will first be inserted without an anti-rotation pin and then held in place by the spring retaining ring 206. If the coin or medallion is free to rotate, the spring retaining ring will then be removed, the anti-rotation pin 216 will be installed in the half round slot 214, and then the spring retaining ring 206 will be reinstalled to complete the mounting. While the anti-rotation pin 216 is shown in a solid cylindrical configuration, it is within the scope of the present invention to have an anti-rotation pin in a jagged or tapered configuration. In this way, the anti-rotation pin serves as a shim, and will generally be custom sized and shaped to allow a snug press fit between the specific undersized coin or medallion being fitted to the frame 202 and the wall of the half round slot 214.

Figure 4:
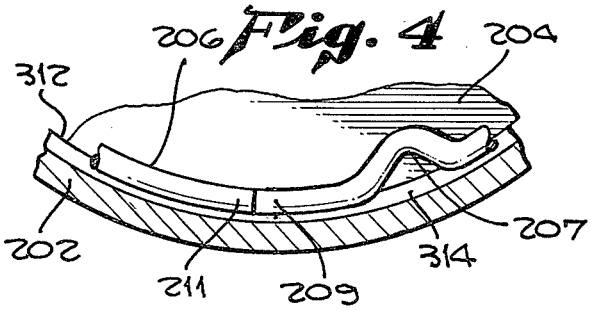
FIG. 4 is a fragmentary sectional view of a section of FIG. 3.

A further improvement of the present invention involves a special design for the spring retaining ring which holds the coin or medallion within the cast frame. It is the object of this improvement to provide a spring retaining ring which securely retains the coin or medallion within the cast frame while at the same time enabling the spring retaining ring to be easily removed should one desire to remove the coin or medallion within the cast frame. To accomplish the goal, the improvement consists of two alternative embodiments. The first embodiment consists of placing a kink near one end of the spring retaining ring 206. This embodiment is disclosed in FIGS. 3 and 4. By way of example, the kink 207 can be approximately within fifteen (15) degrees from one end. As shown in FIG. 3, in this embodiment the spring retaining ring 206 must be placed within the cast frame 202 so that the two open ends 218 and 220 abut one another as closely as possible. The retaining ring has to be specially sized to achieve this goal. The location of the kink 207 relative to the half round slot 214 is not of importance. The kink 207 provides an area where a pin or other small sharp object may be inserted to remove the spring retaining ring 206 should one desire to remove the coin or medallion 204. While the spring retaining ring 206 fits securely within the annular groove 314 of the cast frame 202, the kink 207 allows it to be easily removed.

The second embodiment is disclosed in FIG. 5. In the second embodiment, the spring retaining ring 206 is completely smooth and contains no kink. In order for the completely smooth spring retaining ring 206 to be easily removed, it is necessary that at least one of its open ends 218 and 220 lies approximately within fifteen (15) degrees of the half round slot 214. To be certain that the spring retaining ring 206 is placed within the annular groove 314 of the cast frame such that at least one end 218 or 220 lies within approximately fifteen (15) degrees of the half round slot 214 and to present proper positioning, a web or fill is located within the annular groove 314 which accommodates the spring retaining ring 206. The web or fill 222 can be located adjacent the half round slot 214 and extends for approximately fifeteen (15) degrees. In this way, the ends 218 and 220 of the spring retaining ring 206 abut the edges of the web or fill 222. The web or fill 222 can be located elsewhere in the annular groove 314 so long as it forces at least one end 218 or 220 of the retaining wire to lie within approximately fifteen (15) degrees of the half round slot 214. The spring retaining ring 206 can only be inserted in the annular groove 314 such that the ends 218 or 220 abut the fill 222 and at least one end, 218 or 220, is within approximately fifteen (15) degrees of the location of the notch or half round slot 214. The spring retaining ring must be properly sized to achieve this goal. Through this configuration, the spring retaining ring 206 fits securely within the annular groove 314 and securely retains the coin or medallion 204 within the cast frame 202 while at the same time the spring retaining ring 206 can be easily removed through the use of a safety pin or other small pointed object placed near the end of the spring retaining ring.

In either configuration, the coin or medallion 204 is held securely in place within the cast frame 202 and the spring retaining ring 206 can not be forced out because it is well retained within the annular groove 314 and because the open ends abut each other. This is discussed in detail in previous patent application Ser. No. 06/146,488 now U.S. Pat. No. 4,283,831. With smooth spring retaining ring 206 that contains no kink 207, if the ends 218 and 220 are placed in a location wherein they are further than approximately fifteen (15) degrees from the half round slot 214, it will be extremely difficult (but not impossible) to remove the spring retaining ring 206 using the methods described.

Figure 6:
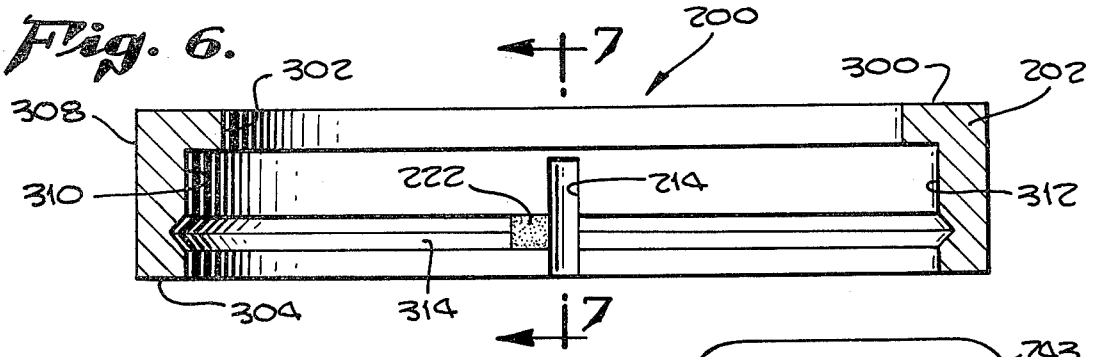
FIG. 6 is a cross-sectional view of the improved circular cast frame.
Figure 7:
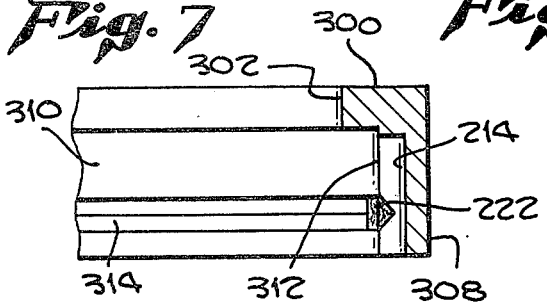
FIG. 7 is a partial cross-sectional view of the improved circular cast frame taken along line 7—7 of FIG. 6.
Figure 8:
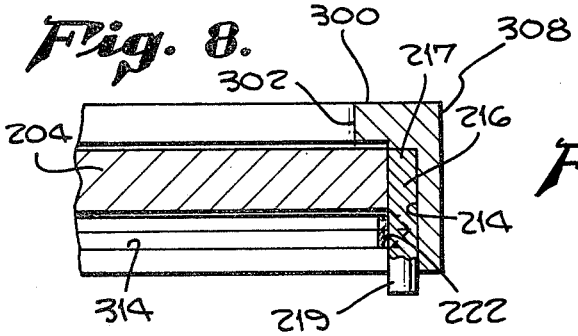
FIG. 8 is a partial cross-sectional view of the improved circular cast frame with the coin or medallion inserted and full anti-rotation pin inserted.

Further views of the insertion process are shown in FIGS. 6 through 9. FIG. 6 discloses a cross-sectional view of the improved circular cast frame assembly 200. FIG. 7 is a cross-sectional view taken along line 7—7 of FIG. 6, before any objects are inserted into cast frame 202. FIG. 8 discloses the coin or medallion 204 inserted with the anti-rotation pin 216 inserted into notch or half round slot 214, but before the excess portion of the anti-rotation pin 216 is broken off. FIG. 9 discloses the completed assembly with coin or medallion 204 inserted, the anti-rotation pin 216 inserted into half round slot 214 and broken off just above the annular groove 314, and spring retaining ring 206 inserted.

Figure 10:
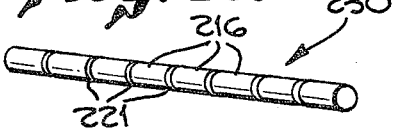
FIG. 10 is a perspective view of multiple anti-rotation pins.

The anti-rotation pin 216 can consist of an upper portion 217 which is inserted into half round slot 214 and a lower portion 219 which is broken off and discarded; the two portions being separated by an indentation. A preferred configuration to the anti-rotation pin 216 is to have a multiple anti-rotation pin assembly 230, as shown in FIG. 10. In this assembly 230, there are multiple anti-rotation pins 216 which are separated by recessed portions 221. Using this configuration, the coin or medallion 204 can be removed and replaced with the same or a different coin or medallion and a section of anti-rotation pin 216 from the anti-rotation pin assembly 230 can be used to fill the half round slot 214 each time the coin or medallion is inserted.

In the preferred embodiment, the cast frame 202 is made of gold and the spring retaining ring 206 is a spring gold ring. Other metals such as silver, brass, platinum or any other material suitable for jewelry can also be used. The anti-rotation pin can be made of any soft metal such as brass. By way of example only, the coin can be a Krugerrand. One advantage of the present embodiment is the ability to remove the Krugerrand easily in the event of a financial emergency. By way of example only, if one's wallet is stolen while on a trip, the Krugerrand can be easily removed and used as an instant source of money.

A further improvement relates to the improved design of cast frames and retaining wires therefor in rectangular and oval configurations. In patent application Ser. No. 06/146,488, now U.S. Pat. No. 4,283,831 medallions or other objects inserted into non-circular cast frames such as rectangular or oval frames were retained therein by two spring gold wires which contained teeth at their respective ends. The teeth fit into slotted holes in the wall of the cast frame. A problem with this configuration arises because the use of a central slot does not allow for reasonable tolerance in making the retaining wires. If the fit of the teeth into the slot is not completely precise, the spring retaining wires are likely to pop out under pressure at the location of the of the central slots in the cast frame.

Figure 11:
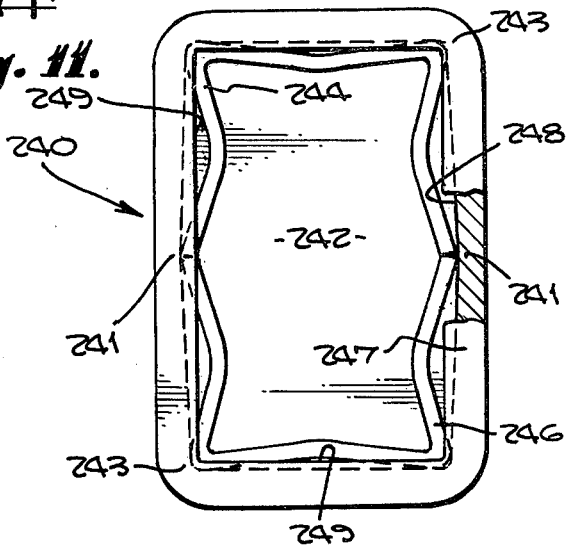
FIG. 11 is a bottom plan view of a completed cast frame in a rectangular configuration, with coin or medallion inserted and supported in place by two spring retaining wires.
Figure 12:
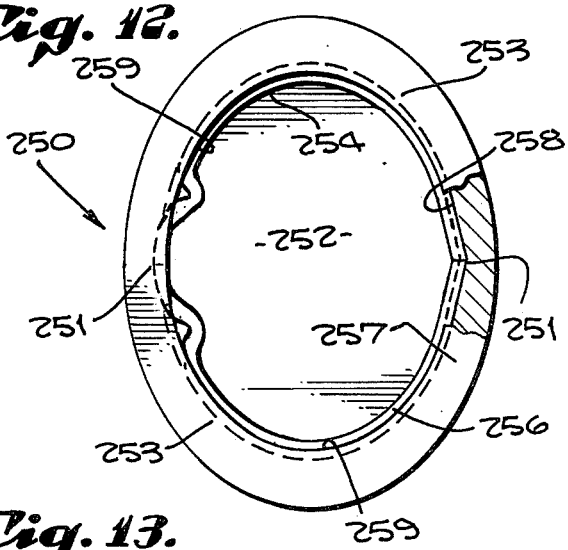
FIG. 12 is a bottom plan view of a completed cast frame in an oval configuration, with coin or medallion inserted and supported in place by two spring retaining wires.
Figure 13:
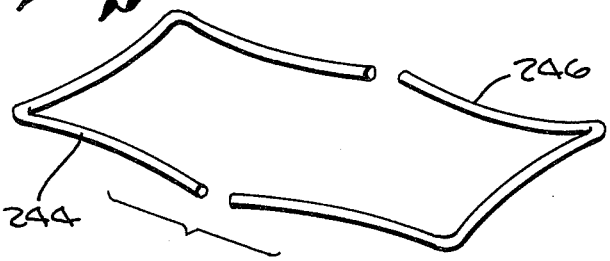
FIG. 13 shows the bowed configuration of the two rectangular shaped retaining wires shown in FIG. 11, wherein both retaining wires are identical in form.

The improved modified configuration for a rectangular shaped frame is shown in the bottom plan view of FIG. 11 and the improved modified configuration for an oval shaped frame is shown in the bottom plan view of FIG. 12. The improved configuration has eliminated the central slots in frames of rectangular and oval configurations and has eliminated the teeth at the ends of the retaining wires. Instead, the retaining wires are configured as shown in FIGS. 11, 12 and 13 and contain no teeth. Further, inside the rectangular shaped frame, the annular groove within which the retaining wires fit is designed at an angle so that the central portion is approximately twenty percent (20%) deeper than the portions at the edges. In this way, the ends of the retaining wires will be further recessed within the annular groove. This recessing combined within the abutting of open ends serves to prevent the retaining wire from popping out when pressure is applied to the face of the coin.

In FIG. 11, the cast frame is shown at 240. Elements of the cast frame similar to the circular configuration are not shown. The cast frame contains a rectangular shaped upper face having a large central opening for exposing the coin or medallion shown at 242, a rectangular lower face shown at 247 having a large central opening, and an outer transverse circumferential wall perpendicular to both the upper face and the lower face. The cast frame also contains an inner transverse circumferential wall shown at 249 perpendicular to both the upper face and the lower face, further containing a transverse critical dimension inner wall adjacent the upper face, the dimensions of the critical dimension inner wall being only slightly larger than the coin or medallion 242 to be retained within it, and an annular groove shown at 248 extending uninterrupted through the entire internal circumference of the inner transverse circumferential wall and beneath the transverse critical dimension inner wall. The annular groove 248 is sloped inwardly at an angle along the lengthwise edges so that its central area 241 is approximately twenty percent (20%) deeper than its outermost edges 243.

The two rectangular shaped spring retaining wires are shown at 244 and 246. The ends of the retaining wires 244 and 246 abut one another and touch at the deepest point 241 within the annular groove 248. In order to assure that the spring retaining wires will not pop out and to further assure that the spring retaining wires can be easily removed if necessary, the longitudinal sides of the spring retaining wires 244 and 246 are bowed in a slightly inward direction as shown in FIG. 13. In this manner, when they are inserted into annular groove 248, they will be pressed into the frame and portions of the retaining wires will be flush with the annular groove 248 in the frame. The sides of the annular groove are approximately at an angle of forty-five degrees to the horizontal to help accommodate the retaining wires. The coin or medallion can be easily removed by placing a safety pin or comparable object at the central longitudinal point of the rectangular wires where the bow is deepest in order to easily remove the retaining wire.

In an alternative embodiment not shown, the entire retaining wire assembly consists of a single rectangular shaped retaining wire instead of two wires. In this embodiment, the two open ends abut one another at a location of the deepest point within the annular groove 248. The longitudinal edges of the wire are also prestressed for the same reasons as described above. In an additional alternative embodiment not shown, a kink may be placed in the wires at a distance adjacent one end. In this way, the wire can be more easily removed through insertion of a small sharp object such as a safety pin at the location of the kink. In the embodiment with two retaining wires, a kink would be placed in each wire to facilitate production. In the embodiment with only a single wire, a kink need only be placed near one end of the single wire.

A similar concept is employed in the oval configuration of FIG. 12 wherein the cast frame is shown at 250. Elements of the cast frame similar to the circular configuration shown in FIG. 5 are not shown here. The cast frame contains an oval shaped upper face having a large central opening for exposing the coin or medallion shown at 252, an oval lower face shown at 257 having a large central opening, and an outer transverse circumferential wall perpendicular to both the upper face and the lower face. The cast frame also contains an inner transverse circumferential wall shown at 259 perpendicular to both the upper face and the lower face, further containing a transverse critical dimension inner wall adjacent the upper face, the dimension of the critical dimension inner wall being only slightly larger than the coin or medallion 252 to be retained within it, and an annular groove shown at 258 extending uninterrupted through the entire internal circumference of the inner transverse circumferential wall and beneath the transverse critical dimension inner wall. The annular groove 258 is sloped inwardly at an angle along the edges so that its central area 251 is approximately twenty percent (20%) deeper than its outmost area 253.

The two semi-oval shaped retaining wires are shown at 254 and 256. The ends of the retaining wires 254 and 256 abut one another and touch at the deepest point 251 within the annular groove 258. The sides of the annular groove are approximately at an angle of forty-five (45) degrees to the horizontal to help accommodate the retaining wires. In the oval configuration, it is not necessary to bow the retaining wires.

In an alternative embodiment not shown, the entire retaining wire assembly consists of a single oval shaped retaining wire instead of two wires. In this embodiment, the two ends abut one another at a location of the deepest point within the annular groove 258.

Since the wire or two wires lie flush within the groove with the open ends abutting each other at a point (or points) which are recessed approximately twenty percent (20%) deeper than the outermost point of the annular groove, it is not easy to remove the retaining wire or wires should one desire to do so. The concepts in providing alternative embodiments in spring retaining rings of circular configuration are applicable in the case of oval shaped retaining wires. As with the circular configuration, it is the object of this improvement to provide oval shaped retaining wires which securely retain the coin or medallion within the cast oval frame while at the same time enabling the retaining wire or wires to be easily removed should one desire to remove the coin or medallion within the cast frame. To accomplish this goal, the improvement consists of two alternative embodiments which are not shown but are comparable to the embodiments shown in FIGS. 3, 4, and 5 for a circular configuration.

The first embodiment consists of placing a kink near one end of the oval retaining wire or wires. Preferably, the kink will be placed approximately within a fifteen (15) degree arc from one end of the oval retaining wire or from one end of each oval retaining wire in the case of multiple wires. A kink in both retaining wires is not essential to easy removal of the two retainers. However, to facilitate production of only one shape and style of semi-oval spring wire preform where pairs of retaining wires are to be utilized, a kink in both wires will generally appear. The retaining wires may then be easily removed by use of a safety pin or other small object inserted at the area of the kink. To be certain that the wire is securely retained, the two ends of the wire (or the two opposite ends of multiple wires) must abut each other as closely as possible. The retaining wires must be specially sized to achieve this goal.

As with a circular configuration, in the second embodiment, the spring retaining wire or wires of oval configuration are completely smooth and have no kink. A notch must be placed in the internal wall. The depth of the notch is not critical so long as it at least comes in contact with the annular groove which accommodates the retaining wires. However, the notch must be positioned within an approximate 15 degree arc from the horizontal or short axis (shown as points 251 in FIG. 12) of the oval frame to facilitate removal of the retaining wire(s). As before, the ends of the retaining wire or wires ideally must abut each other as shown in FIG. 12. To achieve this abutment, the retaining wire(s) must be sized for an exact fit. Through this configuration, the oval retaining wire or wires fit securely within the annular groove, and securely retain the coin or medallion within the cast frame, while at the same time the spring retaining wire or wires can be easily removed through the use of the safety pin or other small pointed object placed in the notch.

The retaining wires for rectangular or oval configurations can be made of any spring wire such as brass or gold.

Since this is a continuation-in-part application of patent application Ser. No. 06/146,488, now U.S. Pat. No. 4,283,831 the inventions have been described in conjunction with cast frames. It is emphasized that the inventions disclosed herein are applicable to any type of frame which contain the configuration described, and are not solely restricted to cast frames. The inventions are applicable to be used in conjunction with frames which are manufactured by means other than casting such as frames which are machined from metal or other solid, rigid material stock such as tube, rod, bar, sheet, or block. Further, the inventions disclosed herein are applicable to be used in conjunction with frames which are struck by metal dies in a press.

Additionally, in each configuration, the ends of the spring retaining rings or retaining wires have been described as abutting each other. This is an ideal configuration. A small gap between the ends of the retaining wire(s) or retaining ring in the various configuration is acceptable provided that the gap is not in excess of one-half the diameter of the retaining wire(s) or retaining ring. This is applicable to a single wire or multiple retaining wires in circular, rectangular or oval configurations.

The present improvement invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus and methods shown are intended only for illustration and for disclosure of an operative embodiment and not to show all of the various forms of modification in which the invention might be embodied.

The invention has been described in considerable detail by providing a disclosure of at least one of its forms. However, such detailed description is not intended in any way to limit the broad features or principles of the invention, or the scope of patent monoply to be granted.

What is claimed is:

1. A cast frame characterized by an upper face having a large central hole for exposing an object, a lower face having a large central hole, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, whereby the improvement is an anti-rotation means for preventing rotational movement of different objects of a circular configuration and approximately the same size in the cast frame, the anti-rotation means comprising:

a. a notch in said inner transverse circumferential wall and extending into said critical dimension inner wall;

b. an anti-rotation pin placed into said notch such that the pin extends into the area of the critical dimension inner wall but does not extend into said annular groove; and c. said anti-rotation pin having a press fit between the object and said notch.

2. The invention as defined in claim 1 wherein said anti-rotation pin is of solid cylindrical configuration.

3. The invention as defined in claim 1 wherein said anti-rotation pin is of jagged configuration and is customized and shaped to serve as a shim.

4. The invention as defined in claim 1 wherein said anti-rotation pin is of tapered configuration and is customized and shaped to serve as a shim.

5. The invention as defined in claim 1, wherein said anti-rotation pin is part of an anti-rotation pin assembly which contains a multiplicity of anti-rotation pins aligned in a single row and separated by depressions which enable the forwardmost anti-rotation pin to be inserted in said notch and broken off from the remainder of the anti-rotation pin assembly at the point of a depression such that the anti-rotation pin assembly provides a means for multiple insertions of an anti-rotation pin.

6. A cast frame characterized by an upper face having a large central hole for exposing an object, a lower face having a large central hole, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, wherein the improvement is an anti-rotation means for preventing rotational movement of different objects of a circular configuration and approximately the same size in the cast frame, the anti-rotation means comprising:

a. a half round slot in said inner transverse circumferential wall and extending into said critical dimension inner wall;

b. an anti-rotation pin placed into said half round slot such that the pin extends into the area of the critical dimension inner wall but does not extend into said annular groove; and c. said anti-rotation pin having a press fit between the object and said half round slot.

7. The invention as defined in claim 4 wherein said anti-rotation pin is of solid cylindrical configuration.

8. The invention as defined in claim 4 wherein said anti-rotation pin is of jagged configuration and acts as a shim.

9. The invention as defined in claim 4 wherein said anti-rotation pin is of tapered configuration and acts like a shim.

10. The invention as defined in claim 4, wherein said anti-rotation pin is part of an anti-rotation pin assembly which contains a multiplicity of anti-rotation pins aligned in a single row and separated by depressions which enable the forwardmost anti-rotation pin to be inserted in said half round slot and broken off from the remainder of the anti-rotation pin assembly at the point of a depression such that the anti-rotation pin assembly provides a means for multiple insertions of an anti-rotation pin.

11. A cast frame characterized by an upper face having a large central hole for exposing an object, a lower face having a large central hole, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, wherein the improvement is a retaining means for use in the cast frame for retaining an object of circular configuration and specific size therein, the retaining means comprising:

a. a notch in said inner transverse circumferential wall and extending through said annular groove and into said critical dimension inner wall;

b. a fill in said annular groove;

c. said fill lying adjacent said notch and extending within said annular groove for a distance less than fifteen (15) degrees;

d. a circular spring retaining ring conforming to the size and shape of said annular groove; and e. said circular spring retaining ring placed into said annular groove such that the ends of the spring retaining ring abut the edge of said fill;

f. whereby the object is securely maintained within the cast frame by the circular spring retaining ring and the circular spring retaining ring can be easily removed by placement of a thin sharp object into said notch.

12. The invention as defined in claim 11 wherein said fill lies within said annular groove such that at least one end of the fill lies within approximately fifteen (15) degrees of said notch while the other end of the fill may be at a further distance.

13. The invention as defined in claim 11 wherein said notch is a half round slot.

14. The invention as defined in claim 11 wherein the ends of the spring retaining ring are separated from the edges of the fill by a gap which is less than one half the diameter of the material of the spring retaining ring.

15. An improved cast frame for retaining a rectangular shaped object therein characterized by an upper face having a large central opening for exposing the object, a rectangular lower face having a large central opening, an outer transverse circumferential wall perpendicular to both the upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be retained within it, wherein the improvement comprises:

a. an annular groove within said inner transverse circumferential wall running beneath the critical dimension inner wall;

b. said annular groove extending uninterrupted through the entire internal circumference of said inner transverse circumferential wall, the annular groove containing sides at approximately a forty-five (45) degree angle to the horizontal and said annular groove having its lengthwise walls sloping outwardly such that the central area of the lengthwise wall of the annular groove is approximately twenty percent (20%) deeper than the outermost portion of the lengthwise wall;

c. a first three-sided rectangular shaped retaining wire whose three longitudinal sides are bowed inward and whose ends are smooth and without teeth;

d. a second three-sided rectangular shaped retaining wire whose three longitudinal sides are bowed inward and whose ends are smooth and without teeth; and e. said first and said second rectangular shaped retaining wires being placed in said annular groove such that their respective corner portions contact the corner portions of said annular groove and their respective ends nearly abut one another at the central area of the lengthwise walls of said annular groove;

f. wherein the bowed longitudinal sides enable portions of each retaining wire to lie flush against the wall of said annular groove and said first and said second rectangular shaped retaining wires may be easily removed by placement of a thin sharp object in the area of the bow of a longitudinal side.

16. The invention as defined in claim 15 wherein said first three-sided rectangular shaped retaining wire contains a kink adjacent one end and said second three-sided rectangular shaped retaining wire contains a kink adjacent one end, whereby the first and the second three-sided rectangular shaped retaining wires may be easily removed by placement of a thin sharp object at the location of the kink in each retaining wire.

17. The invention as defined in claim 15 wherein the ends of the first and the second rectangular shaped retaining wires are separated by a gap which is less than one half the diameter of the retaining wires.

18. An improved cast frame for retaining a rectangular shaped object therein characterized by an upper face having a large central opening for exposing the object, a rectangular lower face having a large central opening, an outer transverse circumferential wall perpendicular to both the upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be retained within it, wherein the improvement comprises:

a. an annular groove within said inner transverse circumferential wall running beneath the critical dimension inner wall;

b. said annular groove extending uninterrupted through the entire internal circumference of said inner transverse circumferential wall, the annular groove containing sides at approximately a forty-five (45) degree angle to the horizontal and said annular groove having its lengthwise walls sloping outwardly such that the central area of a lengthwise wall of the annular groove is approximately twenty percent (20%) deeper than the outermost portion of the lengthwise section;

c. a rectangular shaped retaining wire whose sides are bowed inward and whose ends are smooth and without teeth; and d. said rectangular shaped retaining wire being placed in said annular groove such that its corner portions contact the corner portions of said annular groove and its ends nearly abut one another at the central area of one of the lengthwise walls of said annular groove;

e. wherein the bowed longitudinal sides enable portions of said rectangular shaped retaining wire to lie flush against the wall of said annular groove and said retaining wire may be easily removed by placement of a thin sharp object in the area of the bow of a side.

19. The invention as defined in claim 18 wherein said rectangular shaped retaining wire contains a kink adjacent one end, whereby the rectangular shaped retaining wire may be easily removed by placement of a thin sharp object at the location of the kink in the retaining wire.

20. The invention as defined in claim 18 wherein the ends of the rectangular shaped retaining wire are separated by a gap which is less than one half the diameter of the retaining wire.

21. An improved cast frame for retaining an oval shaped object therein, characterized by an oval upper face having a large central opening for exposing the object, an oval lower face having a large central opening, an outer transverse circumferential wall perpendicular to both upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be encased within it; wherein the improvement comprises:

a. an annular groove within said inner transverse circumferential wall running beneath the critical dimension inner wall;

b. said annular groove extending uninterrupted through the entire internal circumference of said inner transverse circumferential wall, the annular groove containing sides at approximately a forty-five degree angle to the horizontal and said annular groove sloping outwardly such that the central area of the lengthwise walls is approximately twenty percent (20%) deeper than the central area of the widthwise walls;

c. a first semi-oval shaped retaining wire conforming to the size and shape of one half of said annular groove;

d. said first semi-oval shaped retaining wire having ends which are smooth and without teeth;

e. a second semi-oval shaped retaining wire conforming to the size and shape of one half of said annular groove;

f. said second semi-oval shaped retaining wire having ends which are smooth and without teeth; and g. said first and second semi-oval shaped retaining wires being placed in said annular groove such that their ends nearly abut one another at the central area of the lengthwise walls of said annular groove;

h. wherein said first and said second semi-oval shaped retaining wires lie flush against the wall of said annular groove.

22. The invention as defined in claim 21 wherein the ends of the first and the second semi-oval retaining wires are separated by a gap which is less than one half the diameter of the retaining wires.

23. An improved cast frame for retaining an oval shaped object therein, characterized by an oval upper face having a large central opening for exposing the object, an oval lower face having a large central opening, an outer transverse circumferential wall perpendicular to both the upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be encased within it; wherein the improvement comprises:

a. an annular groove within said inner transverse wall running beneath the critical dimension inner wall;

b. said annular groove extending uninterrupted through the entire internal circumference of said inner transverse circumferential wall, the annular groove containing sides at approximately a forty-five (45) degree angle to the horizontal and said annular groove sloping outwardly such that the central area of the lengthwise walls is approximately twenty percent (20%) deeper than the central area of the widthwise walls;

c. an oval shaped retaining wire conforming to the size and shape of said annular groove;

d. said oval shaped retaining wire having ends which are smooth and without teeth; and e. said oval shaped retaining wire being placed in said annular groove such that its ends nearly abut one another at the central area of one lengthwise wall of said annular groove;

f. wherein said oval shaped retaining wire lies flush against the wall of said annular groove.

24. The invention as defined in claim 23 wherein the ends of the oval shaped retaining wire are separated by a gap which is less than one half the diameter of the retaining wire.

25. A cast frame characterized by an upper face having a large central oval shaped opening for exposing an object, a lower face having a large central oval shaped opening, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, where the improvement is a retaining means for use in the cast frame for retaining an object of oval configuration and specific size therein, the retaining means comprising:

a. first semi-oval shaped retaining wire conforming to the size and shape of one half of said annular groove;

b. said first semi-oval shaped retaining wire containing a kink located within approximately a fifteen (15) degree arc from one end;

c. a second semi-oval shaped retaining wire conforming to the size and shape of one half of said annular groove;

d. said second semi-oval shaped retaining wire containing a kink located within approximately a fifteen (15) degree arc from one end; and e. said first and second semi-oval shaped retaining wires placed into said annular groove such that each end of said first semi-oval shaped retaining wire nearly abuts a corresponding end of said second semi-oval shaped retaining wire;

f. whereby the object is securely maintained within the cast frame by said first and second semi-oval shaped retaining wires but can easily be removed by placement of a thin sharp object at the location of the kink in each retaining wire.

26. The invention as defined in claim 25 wherein the ends of the first and second semi-oval shaped retaining wires are separated by a gap which is less than one half the diameter of the retaining wire.

27. A frame characterized by an upper face having a large central hole for exposing an object, a lower face having a large central hole, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, wherein the improvement is an anti-rotation means for preventing rotational movement of different objects of a circular configuration and approximately the same size in the frame, the anti-rotation means comprising:

a. a notch in said inner transverse circumferential wall and extending into said critical dimension inner wall;

b. an anti-rotation pin placed into said notch such that the pin extends into the area of the critical dimension inner wall but does not extend into said annular groove; and c. said anti-rotation pin having a press fit between the object and said notch.

28. The invention as defined in claim 27 wherein said anti-rotation pin is of solid cylindrical configuration.

29. The invention as defined in claim 27 wherein said anti-rotation pin is of jagged configuration and is customized and shaped to serve as a shim.

30. The invention as defined in claim 27, wherein said anti-rotation pin is part of an anti-rotation pin assembly which contains a multiplicity of anti-rotation pins aligned in a single row and separated by depressions which enable the forwardmost anti-rotation pin to be inserted in said notch and broken off from the remainder of the anti-rotation pin assembly at the point of a depression such that the anti-rotation pin assembly provides a means for multiple insertions of an anti-rotation pin.

31. A frame characterized by an upper face having a large central hole for exposing an object, a lower face having a large central hole, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, wherein the improvement is an anti-rotation means for preventing rotational movement of different objects of a circular configuration and approximately the same size in the frame, the anti-rotation means comprising:

a. a half round slot in said inner transverse circumferential wall and extending into said critical dimension inner wall;

b. an anti-rotation pin placed into said half round slot such that the pin extends into the area of the critical dimension inner wall but does not extend into said annular groove; and c. said anti-rotation pin having a press fit between the object and said half round slot.

32. The invention as defined in claim 31 wherein said anti-rotation pin is of solid cylindrical configuration.

33. The invention as defined in claim 31 wherein said anti-rotation pin is of jagged configuration and acts like a shim.

34. The invention as defined in claim 31, wherein said anti-rotation pin is part of an anti-rotation pin assembly which contains a multiplicity of anti-rotation pins aligned in a single row and separated by depressions which enable the forwardmost anti-rotation pin to be inserted in said half round slot and broken off from the remainder of the anti-rotation pin assembly at the point of a depression such that the anti-rotation pin assembly provides a means for multiple insertions of an anti-rotation pin.

35. A frame characterized by an upper face having a large central hole for exposing an object, a lower face having a large central hole, an inner transverse circumferential wall containing a transverse critical dimension inner wall portion adjacent the upper face, the circumference of the critical dimension inner wall being only slightly larger than the corresponding circumference of the object to be retained within it, an annular groove in the inner transverse circumferential wall and beneath the critical dimension inner wall, within the improvement is a retaining means for use in the frame for retaining an object of circular configuration and specific size therein, the retaining means comprising:

a. a notch in said inner transverse circumferential wall and extending through said annular groove and into said critical dimension inner wall;

b. a fill in said annular groove;

c. said fill lying adjacent said notch and extending within said annular groove for a distance less than fifteen (15) degrees);

d. a circular spring retaining ring conforming to the size and shape of said annular groove; and e. said circular spring retaining ring placed into said annular groove such that the ends of the spring retaining ring abut the edge of said fill;

f. whereby the object is securely maintained within the frame by the circular spring retaining ring and the circular spring retaining ring can be easily removed by placement of a thin sharp object into said notch.

36. The invention as defined in claim 35, wherein said fill lies within said annular groove such that at least one end of the fill lies within approximately fifteen (15) degrees of said notch while the other end of the fill may be at a further distance.

37. The invention as defined in claim 35, wherein said notch is a half round slot.

38. An improved frame for retaining a rectangular shaped object therein characterized by an upper face having a large central opening for exposing the object, a rectangular lower face having a large central opening, an outer transverse circumferential wall perpendicular to both the upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be retained within it, wherein the improvement comprises:

a. an annular groove within said inner transverse circumferential wall running beneath the critical dimension inner wall;

b. said annular groove extending uninterrupted through the entire internal circumference of said inner transverse circumferential wall, the annular groove containing sides at approximately a forty-five (45) degree angle to the horizontal and said annular groove having its lengthwise walls sloping outwardly such that the central area of the lengthwise wall of the annular groove is approximately twenty percent (20) deeper than the outermost portion of the lengthwise wall;

c. a first three-sided rectangular shaped retaining wire whose three longitudinal sides are bowed inward and whose ends are smooth and without teeth;

d. a second three-sided rectangular shaped retaining wire whose three longitudinal sides are bowed inward and whose ends are smooth and without teeth; and e. said first and said second rectangular shaped retaining wires being placed in said annular groove such that their respective corner portions contact the corner portions of said annular groove and their respective ends nearly abut one another at the central area of the lengthwise walls of said annular groove;

f. wherein the bowed longitudinal sides enable portions of each retaining wire to lie flush against the wall of said annular groove and said first and said second rectangular shaped retaining wires may be easily removed by placement of a thin sharp object in the area of the bow of a longitudinal side.

39. The invention as defined in claim 38, wherein said first three-sided rectangular shaped retaining wire contains a kink adjacent one end and said second three-sided rectangular shaped retaining wire contains a kink adjacent one end, whereby the first and the second three-sided rectangular shaped retaining wires may be easily removed by placement of a thin sharp object at the location of the kink in each retaining wire.

40. The invention as defined in claim 38, wherein the ends of the first and the second rectangular shaped retaining wires are separated by a gap which is less than one half the diameter of the retaining wires.

41. An improved frame for retaining a rectangular shaped object therein characterized by an upper face having a large central opening for exposing the object, a rectangular lower face having a large central opening, an outer transverse circumferential wall perpendicular to both the upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be retained within it, wherein the improvement comprises:

a. an annular groove within said inner transverse circumferential wall running beneath the critical dimension inner wall;

b. said annular groove extending uninterrupted through the entire internal circumference of said inner transverse circumferential wall, the annular groove containing sides at approximately a forty-five (45) degree angle to the horizontal and said annular groove having its lengthwise walls sloping outwardly such that the central area of a lengthwise wall of the annular groove is approximately twenty percent (20%) deeper than the outermost portion of the lengthwise section;

c. a rectangular shaped retaining wire whose sides ae bowed inward and whose ends are smooth and without teeth; and d. said rectangular shaped retaining wire being placed in said annular groove such that its corner portions contact the corner portions of said annular groove and its ends nearly abut one another at the central area of one of the lengthwise walls of said annular groove;

e. wherein the bowed longitudinal sides enable portions of said rectangular shaped retaining wire to lie flush against the wall of said annular groove and said retaining wire may be easily removed by placement of a thin sharp object in the area of the bow of a side.

42. The invention as defined in claim 41, wherein said rectangular shaped retaining wire contains a kink adjacent one end, whereby the rectangular shaped retaining wire may be easily removed by placement of a thin sharp object at the location of the kink in the retaining wire.

43. The invention as defined in claim 41, wherein the ends of the rectangular shaped retaining wire are separated by a gap which is less than one half the diameter of the retaining wire.

44. An improved frame for retaining an oval shaped object therein, characterized by an oval upper face having a large central opening for exposing the object, an oval lower face having a large central opening, an outer transverse circunferential wall perpendicular to both upper face and the lower face, an inner transverse circumferential wall perpendicular to both the upper face and the lower face containing a transverse critical dimension inner wall adacent the upper face, the circumference of the critical dimension inner wall being only slightly larger than the circumference of the object to be encased within it; wherein the improvement comprises:

a. an annular groove within said inner transverse circumferential wall running beneath the critical dimension inner wall, b. said annular groove extending uninterrupted through the entire internal circumference of said inner transverse circumferential wall, the annular groove containing sides at approximately a forty-five degree angle to the horizontal and said annular groove sloping outwardly such that the central area of the lengthwise walls is approximately twenty percent (20%) deeper than the central area of the widthwise walls;

c. a first semi-oval shaped retaining wire conforming to the size and shape of one half of said annular groove;

d. said first semi-oval shaped retaining wire having ends which are smooth and without teeth;

e. a second semi-oval shaped retaining wire conforming to the size and shape of one half of said annular groove;

f. said second semi-oval shaped retaining wire having ends which are smooth and without teeth; and g. said first and second semi-oval shaped retaining wires being placed in said annular groove such that their ends nearly abut one another at the central area of the lengthwise walls of said annular groove;

h. wherein said first and said second semi-oval shaped retaining wires lie flush against the wall of said annular groove.

45. An improved frame for retaining an oval shaped object therein, characterized by an oval upper face having a large central opening for exposing the object, an oval lower face having a large central opening, an outer transverse circumferential wall perpendicular to both the upper face and the lower face, an inner transverse circumferential wall perpendicular to both the upper face and the lower face containing a transverse critical dimension inner wall adjacent the upper face, the circumference of the critical dimension inner wall being only slightly larger than the circumference of the object to be encased within it; wherein the improvement comprises:

a. an annular groove within said inner transverse circumferential wall running beneath the critical dimension inner wall;

b. said annular groove extending uninterrupted through the entire internal circumference of said inner transverse circumferential wall, the annular groove containing sides at approximately a forty-five (45) degree angle to the horizontal and said annular groove sloping outwardly such that the central area of the lengthwise walls is approximately twenty percent (20%) deeper than the central area of the widthwise walls;

c. an oval shaped retaining wire conforming to the size and shape of said annular groove;

d. said oval shaped retaining wire having ends which are smooth and without teeth; and e. said oval shaped retaining wire being placed in said annular groove such that its ends nearly abut one another at the central area of one lengthwise wall of said annular groove;

f. wherein said oval shaped retaining wire lies flush against the wall of said annular groove.

46. A frame characterized by an upper face having a large central oval shaped opening for exposing an object, a lower face having a large central oval shaped opening, an inner transverse circumferential wall containing a transverse critical dimension inner wall portion adjacent the upper face, the circumference of the critical dimension inner wall being only slightly larger than the corresponding circumference of the object to be retained within it, and an annular groove in the inner transverse circumferential wall and beneath the critical dimension inner wall, wherein the improvement is a retaining means for use in the frame for retaining an object of oval configuration and specific size therein, the retaining means comprising:

a. first semi-oval shaped retaining wire conforming to the size and shape of one half of said annular groove;

b. said first semi-oval shaped retaining wire containing a kink located within approximately a fifteen (15) degree arc from one end;

c. a second semi-oval shaped retaining wire conforming to the size and shape of one half of said annular groove;

d. said second semi-oval shaped retaining wire containing a kink located within approximately a fifteen (15) degree arc from one end; and e. said first and second semi-oval shaped retaining wires placed into said annular groove such that each end of said first semi-oval shaped retaining wire nearly abuts a corresponding end of said second semi-oval shaped retaining wire;

f. whereby the object is securely maintained within the frame by said first and second semi-oval shaped retaining wires but can easily be removed by placement of a thin sharp object at the location of the kink in each retaining wire.

47. The invention as defined in claim 44, wherein the ends of the first and the second semi-oval retaining wires are separated by a gap which is less than one half the diameter of the retaining wires.

48. The invention as claimed in claim 45 wherein the ends of the oval shaped retaining wire are separated by a gap which is less than one half the diameter of the retaining wire.

49. The invention as defined in claim 46, wherein the ends of the first and second semi-oval shaped retaining wires are separated by a gap which is less than one half the diameter of the retaining wire.

* * * * *